US005169198A

United States Patent [19]

Volk et al.

[11] Patent Number: 5,169,198

[45] Date of Patent: Dec. 8, 1992

[54] HANDLE FOR BAGGED ITEMS

[75] Inventors: Donald J. Volk; Steven J. Volk; Daniel J. Volk, all of Turlock, Calif.

[73] Assignee: Volk Investment Co., Turlock, Calif.

[21] Appl. No.: 687,848

[22] Filed: Apr. 19, 1991

[51] Int. Cl.[5] ..... B65D 33/06

[52] U.S. Cl. ..... 294/137; 294/166; 383/6

[58] Field of Search ..... 294/137, 148, 166; 383/6, 13, 25, 71, 78; 24/30.5 S, 130

[56] References Cited

U.S. PATENT DOCUMENTS

| | | | |
|---|---|---|---|
| 2,981,990 | 5/1961 | Balderree, Jr. | 383/25 X |
| 3,548,906 | 12/1970 | Murphy | 383/25 |
| 4,090,729 | 5/1978 | Erickson | 294/166 X |
| 4,616,749 | 10/1986 | Briggs | 294/166 X |
| 4,772,133 | 9/1988 | Volk | 383/6 |
| 4,818,121 | 4/1989 | Volk | 383/6 |
| 4,896,366 | 1/1990 | Oxman | 383/71 |

*Primary Examiner*—Russell D. Stormer
*Assistant Examiner*—Dean J. Kramer
*Attorney, Agent, or Firm*—Julian Caplan

[57] ABSTRACT

A flat, open handle clips onto the end of a bag such as, for example, a shrink-wrap plastic bag, for frozen poultry or similar frozen food items. The handle has an elliptical ring at one end through which the end of the bag fits, and is provided with flexible converging fingers to retain the bag within the ring once it is inserted. The gripping portion of the handle which the fingers of the user grip is at the opposite end. Relatively flexible arms interconnect the gripping portion and the ring. To strengthen the handles and also to guide the bag toward the ring after its end has been inserted in the opening in the handle, guides are provided. In one form of the invention the guides extend inwardly from each arm, then bend obliquely to merge with the retaining fingers. In another form of the invention the guides are thin ears which have rounded inner edges.

3 Claims, 1 Drawing Sheet

HANDLE FOR BAGGED ITEMS

BACKGROUND OF THE INVENTION

1. Field of the Invention

This invention relates to a new and improved plastic handle for bagged items and more particularly relates to a handle which may be attached to the plastic bag which is commonly used to package frozen poultry and other products to facilitate carrying. Use of this . device makes it unnecessary to reinforce the bag with netting, commonly used heretofore.

2. Description of Related Art

Handles have been used for this purpose for some years and are shown in U.S. Pat. Nos. 4,772,133 and 4,818,121. The present invention is an improvement on these prior handles in that the structure facilitates installation of the handle on bagged poultry and also makes it possible to use a lighter weight handle to grip heavy items by providing reinforcement. In one modification of the invention, apertures are formed in the reinforcement to reduce the quantity of plastic used and also provides a location for attachment of tags.

SUMMARY OF THE INVENTION

U.S. Pat. No. 4,818,121 shows an improved carrying handle which has a distal clamp provided with flexible fingers which permit the neck of the closed bag to be forced into the clamp and prevent it from subsequently being displaced. The present invention guides the bag neck into the narrow throat between the fingers, making it easier for the workman applying the handle to do so using only onehand and to do so with greatest rapidity. Additionally, reinforcement is provided so that the handle does not break when it is used to support heavy items such as large frozen turkeys.

DESCRIPTION OF DRAWINGS

The accompanying drawings, which are incorporated in and form a part of this specification, illustrate embodiments of the invention and, together with the description, serve to explain the principles of the invention.

DESCRIPTION OF PREFERRED EMBODIMENTS

Figure 1:
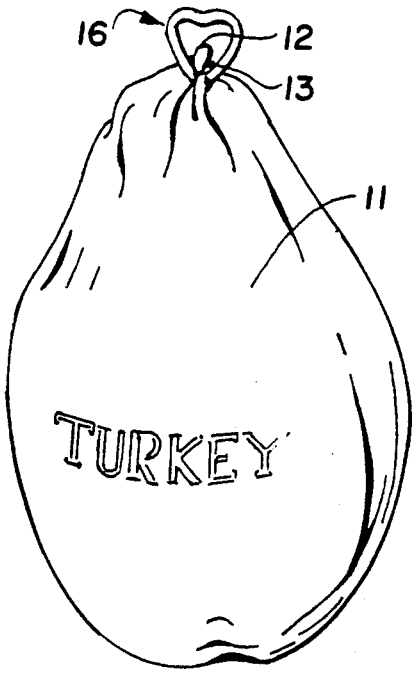
FIG. 1 is a schematic perspective view showing a handle in accordance with the present invention attached to a bagged frozen turkey.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

At the present time turkeys are frequently processed, encased in plastic bags which are shrinkwrapped. The open end of the bag is closed and sometimes is held closed by a clip or other means. Reference is made to U.S. Pat. Nos. 4,772,133 and 4,818,121 for the details of such bags. The present invention is an improvement upon the handles of these two prior patents and makes it possible to use bags for even very heavy turkeys which are not reinforced with netting.

Directing attention to the unitary, substantially planar molded plastic handles 16 shown in FIGS. 2–6, at the distal end thereof is an elliptical clamp ring 17 having a hole 18 therein. The ends 19 of the ring 17 are spaced apart so that there is an opening 21 therebetween. The ring 17 is attached to the remainder of the handle by connections 22. On either side of the handle are converging resiliently flexible fingers 23 and there are obtuse-angled triangular shaped openings 24 on either side between the fingers 23 and the connections 22. When the closed bag neck end 12 is drawn into the opening 18 past the fingers 21 (as hereinafter appears), the fingers 23 flex outwardly into the openings 24 to allow passage of the closed end 12, and after the closed end is within the opening 18 they return to initial position thereby securing the closed end 12 within the ring opening 18 so that it cannot accidentally be dislodged.

On the proximal end of the handle 16 is a transverse, relatively straight finger grip 26, the outer edge of which may be reinforced by a rib 27. Rib 27 may be enlarged over that shown in the drawings to accommodate a label applied by various means such as silk screening, piercing or the like. On either ends of the grip 26 are curved ends 28 which merge into inwardly converging, reduced thickness, flexible arms 29 which join the connections 22. Initially, the closed end 12 of bag 11 is inserted in the opening 36 and is pulled toward the opening 18. Guide arms 31 attached to the converging arms 29 are disposed at an angle of about 90 degrees with respect to each other, and in any event the angle therebetween is considerably greater than the angle between the arms 29. The distal ends of guide arms 31 are connected to connections 22 by thin connectors 32, the inner ends of which are disposed at an acute angle with respect to each other, considerably greater than the angles between the arms 29 and the arms 31. Thus, there is a throat 34 which converges from the central opening 36 towards the opening 21 which guides the end 12 from its original insertion in the opening 36 into the opening 18 of ring 17. The converging arms 29 and 31 facilitate rapid application of the handle to the bag and make it easier to do so with one hand. Thus opening 36 is in the general shape of an isosceles triangle with finger grip 26 constituting the base.

It will be seen that the arms 29 provide a reinforcement resisting any tendency of the angle between the guide arms 31 and connectors 32 to open out under the weight of the bird carried by handle 26. The structure of FIGS. 1–6 materially assists in installing the handle on the bag 11 and also reinforces the handle so that it does not bend or break under the load of the bag and its content. Openings 33 reduce the quantity of plastic required but also are a convenience for attaching tags bearing the processor's name and advertisement, price information and coupons.

A modification of the invention is shown in FIGS. 5–8 wherein the handle is used for lighter weight loads. The proximal end of the handle 16a may be formed with two arcuate portions 41 which receive two fingers of the user and are connected together by a transverse connection 42 which is reinforced by an external web 43. Thus the user may insert one finger inside each of the arcuate portions 41.

Figure 5:
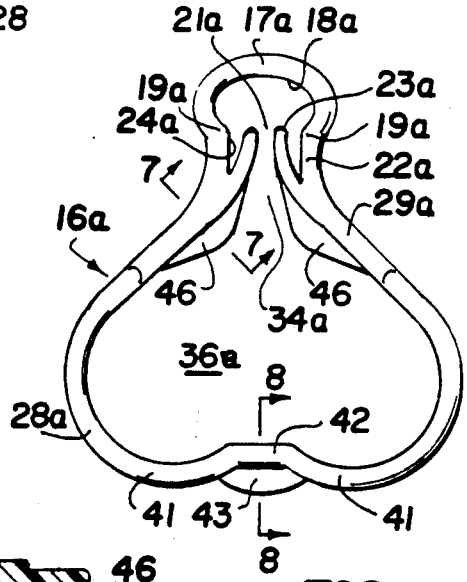
FIG. 5 is a view similar tô view to FIG. 2 of a modified handle.

To direct the closed end 12 of the bag 11 into the throat 34a, opposed guide ears 46 are affixed to the insides of the reduced thickness converging arms 29a as best shown in FIG. 5. Thus the distal ends of the ears 46 merge with the inner edges of the fingers 23a.

In use of the handle of FIGS. 5–8, the end 12 of bag 11 is inserted in the opening 36a and pulled distally, being guided by the segment-shaped ears 46 into the throat 34a and thence into the opening 21a. As the end 12 passes the fingers 23a they flex outwardly into the spaces 24a. After the bag has passed the distal ends of the fingers 23a, the latter flex back to initial position, preventing the handle from being detached from the bag.

Figure 2:
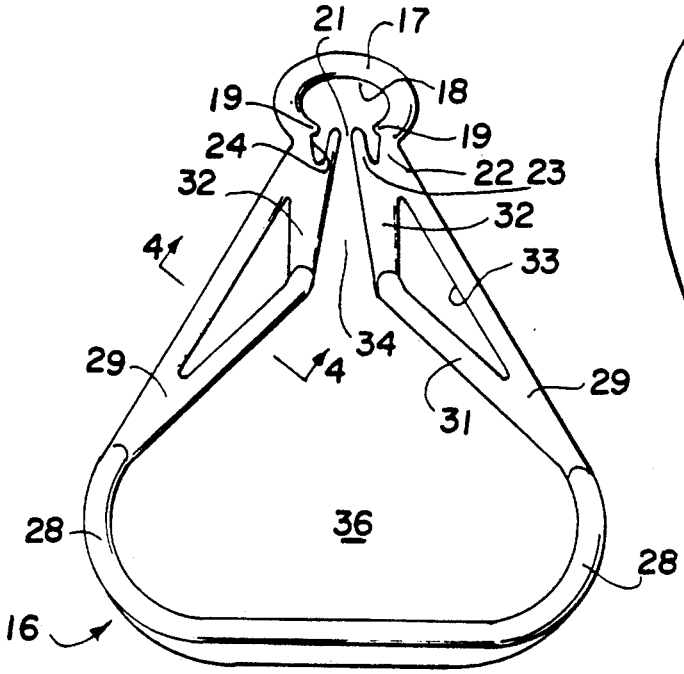
FIG. 2 is an enlarged plan view of one form of handle of the present invention.
Figure 3:
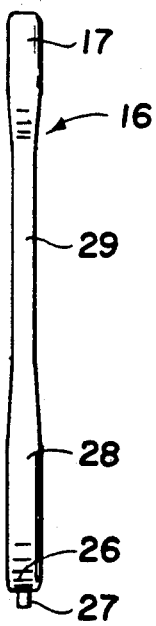
FIG. 3 is an inverted side elevational view of the structure of FIG. 2.
Figure 6:
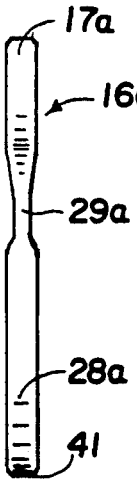
FIG. 6 is a side elevational view of the structure of FIG. 5.
Figure 7:
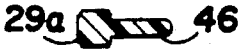
FIGS. 7 and 8 are fragmentary sectional views taken substantially along the lines 7—7 and 8—8 of FIG. 5.
Figure 4:
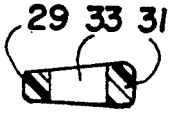
FIG. 4 is a sectional view take substantially along the line 4—4 of FIG. 2.
Figure 8:
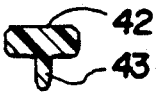

In other respects the modification of FIGS. 5 –8 resembles that of FIGS. 2–4 and the same reference numerals, followed by the subscript a, are used to designate corresponding elements.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A unitary, substantially planar device for use with an item wrapped in a bag having a gathered-together bag end, comprising clamping means having a ring dimensioned to grip said bag inwardly of said gathered-together end and thereby attach said device to said bag for convenient carrying, said ring being formed with a split providing spaced apart ring ends, finger hold means remote from said clamping means having a transverse handle having opposed ends, said handle having a substantially straight finger grip and a thin reinforcing rib on an outer edge of said finger grip, a pair of flexible arms, each said arm interconnecting one of said opposed ends and one of said ring ends, said finger hold means, said flexible arms and said clamping means defining a central opening of generally isosceles triangular shape wherein said handle comprises the base of said triangle, guide means extending from each of said flexible arms inwardly of said central opening to restrict said central opening and thence extending toward said split in said ring, there being a relatively narrow throat between the inner edges of said guide means, and at least one finger extending from said guide means into said throat, said finger being resiliently flexible and adapted to bend between a first position to facilitate insertion of said bag end into said ring as it is moved from said central opening between said guide means and then between said split ends and to move to a second position to prevent said bag end from escaping from said ring, each said guide means comprising a guide arm extending from a point on one said flexible arm intermediate the ends of said flexible arm inwardly at an angle to said flexible arm and a connector from the distal end of said one guide arm at an angle to said guide arm to the intersection of said one guide arm and one of said ring ends, said finger being an extension of said connector, said device being formed with an obtuse angled triangle shaped second opening between said one flexible arm and said guide arm and said connector.

2. A unitary, substantially planar device for use with an item wrapped in a bag having a gathered-together bag end, comprising clamping means having a ring dimensioned to grip said bag inwardly of said gathered-together end and thereby attach said device to said bag for convenient carrying, said ring being formed with a split providing spaced apart ring ends, finger hold means remote from said clamping means having a transverse handle having opposed ends, a pair of flexible arms, each said arm interconnecting one of said opposed ends and one of said ring ends, said finger hold means, said flexible arms and said clamping means defining a central opening of generally isosceles triangular shape wherein said handle comprises the base of said triangle, guide means extending from each of said flexible arms inwardly of said central opening to restrict said central opening and thence extending toward said split in said ring, there being a relatively narrow throat between the inner edges of said guide means, and at least one finger extending from said guide means into said throat, said finger being resiliently flexible and adapted to bend between a first position to facilitate insertion of said bag and into said ring as it is moved from said central opening between said guide means and then between said split ends and to move to a second position to prevent said bag end from escaping from said ring, each said guide means comprising a generally segmentshaped ear on the inside of one said flexible arm adjacent one said finger, said segment-shaped ear having a chord, said flexible arm comprising said chord, the distal end of said ear merging with said finger, said ear being substantially thinner than said flexible arm at the area of said flexible arm from which said ear projects, said finger hold means comprising a first arcuate portion on one side of said device and a complementary second arcuate portion on the opposite side of said device, said arcuate portions curving distally outwardly to merge into one of said flexible arms and curving proximally inwardly and toward said central opening, a connection joining the proximal ends of said arcuate portions along the base of said isosceles triangle, and a web projecting outwardly of said connection on the side of said connection opposite said central opening to limit outward bending of said arcuate portions in the areas of their curving proximally inward.

3. A device according to claim 2 wherein there are two flexible fingers, said fingers diverging when in first position and converging when in second position, said device being formed with second openings outward of said fingers when said fingers are in second position, said fingers when in first position flexing outward into said second openings, said ring ends limiting outward flexing of said fingers.

* * * * *